US008535517B2

(12) United States Patent
Choi

(10) Patent No.: US 8,535,517 B2
(45) Date of Patent: Sep. 17, 2013

(54) METHOD FOR TREATING WASTE PETROLEUM

(76) Inventor: Hong Yoon Choi, Busan (KR)

( * ) Notice: Subject to any disclaimer, the term of this patent is extended or adjusted under 35 U.S.C. 154(b) by 1021 days.

(21) Appl. No.: 12/571,334

(22) Filed: Sep. 30, 2009

(65) Prior Publication Data

US 2010/0094073 A1 Apr. 15, 2010

Related U.S. Application Data

(63) Continuation of application No. PCT/KR2007/006800, filed on Dec. 24, 2007.

(30) Foreign Application Priority Data

Apr. 13, 2007 (KR) ..... 10-2007-0036593

(51) Int. Cl.
*C10M 175/02* (2006.01)
*G21F 9/16* (2006.01)

(52) U.S. Cl.
USPC ..... 208/181; 208/179; 208/266; 208/273; 588/2; 588/6

(58) Field of Classification Search
USPC ..... 208/179, 181, 266, 273; 588/2, 588/6
See application file for complete search history.

(56) References Cited

U.S. PATENT DOCUMENTS

| | | | | |
|---|---|---|---|---|
| 3,607,731 | A * | 9/1971 | Gulick | 208/181 |
| 5,844,008 | A * | 12/1998 | McMillan | 521/99 |
| 2006/0135628 | A1 | 6/2006 | Newman et al. | |
| 2007/0175793 | A1 * | 8/2007 | Narine et al. | 208/49 |

FOREIGN PATENT DOCUMENTS

| | | | |
|---|---|---|---|
| JP | 07268315 | A | 10/1995 |
| JP | 10316962 | A | 12/1998 |

* cited by examiner

*Primary Examiner* — Walter D Griffin
*Assistant Examiner* — Renee E Robinson
(74) *Attorney, Agent, or Firm* — Park & Associates IP Law, P.C.

(57) ABSTRACT

The present invention relates to a method for treating various waste petroleum into eco-friendly solid so that leaching of oil would not occur. The method of the present invention can treat radioactive waste petroleum as well as various waste petroleum, thereby stabilizing waste petroleum chemically and physically, wherein the method comprises mixing waste petroleum with a sulfuric acid and a nitric acid; adding sodium hydroxide, thereby carrying out a polymerization reaction to produce solid particles; colloidizing a mixture obtained by uniformly stirring the solid particles; adding a diisocyanate compound in reactor, thereby carrying out a subsequent polymerization reaction to obtain a new compound in the form of powder; discharging a generated gas into the atmosphere; and filling the powder into a resin as a filling material and compression molding and reclaiming the filled powder.

1 Claim, 3 Drawing Sheets toluene 2,4 - diisocyanate toluene 2,5 - diisocyanate
(Desmodur T)

4,4' - diphenylmethane diisocyanate
(Desmodur M)

METHOD FOR TREATING WASTE PETROLEUM

REFERENCE TO RELATED APPLICATIONS

This is a continuation of International Patent Application PCT/KR2007/006800 filed on Dec. 24, 2007, which designates the United States and claims priority of Korean Patent Application No. 10-2007-0036593 filed on Apr. 13, 2007, the entire contents of which are incorporated herein by reference.

FIELD OF THE INVENTION

The present invention relates to a method for treating waste petroleum, and more specifically relates to providing a method for treating various waste petroleum (such as a lubricating oil, a refrigerating oil, an insulating oil and the like used in general machinery and equipment as well as in particular radioactive waste petroleum) into eco-friendly solid to prevent an oil leaching from occurring.

BACKGROUND OF THE INVENTION

Generally, various waste petroleum are classified into designated wastes under Wastes Control Act, and has been collected, and incinerated or purified into recovery oil by waste recovery companies.

Meanwhile, the waste petroleum used in nuclear power station, etc., has been separately treated in a radioactive waste treating facility to interrupt outflow of radioactive materials. Accordingly, various researches and developments to solidify radioactive waste oil permanently without an oil leaching has been carried out reiteratively and to store them permanently in a radioactive waste treating facility. As a result, there has been proposed a method for solidifying radioactive waste oil, in which radioactive waste petroleum is filled and fixed with cement with a ratio of 1:99. However, in the case of the method, it is impossible to prevent an oil leaching phenomenon that occurs within a few hours. Further, the conventional method does not eco-friendly treat waste petroleum and there are various difficult problems in relation to construction of a radioactive waste treating facility.

SUMMARY OF THE INVENTION

It is an object of the present invention to provide a method for treating waste petroleum that can solve the various problems of the prior art as mentioned above.

To achieve the above objects, the present invention provides a method for treating waste petroleum comprising a series of steps as follows to treat the waste petroleum into eco-friendly solids.

That is, the inventors observed and analyzed properties of mixed radioactive waste petroleum in terms of various aspects, and developed a method for treating the waste petroleum in terms of a synthetic polymer by preceding a polymerization process. The present invention will be described in detail below. In an example of the present invention, radioactive waste petroleum was used as a sample.

The present invention provides a method for treating waste petroleum, which can treat waste petroleum eco-friendlily, and wherein the method comprises mixing waste petroleum with a concentrated sulfuric acid and a concentrated nitric acid; adding sodium hydroxide, thereby carrying out a polymerization reaction to produce solid particles; colloidizing a mixture obtained by uniformly stirring the solid particles; adding a diisocyanate compound in reactor, thereby carrying out subsequent polymerization reaction to obtain a new compound in the form of powder; discharging a generated gas into the atmosphere; and filling the compound into a resin as a filling material and compression molding and reclaiming the filled compound.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

The present invention is described in detail as follows.

10-15% by weight of a mixture of a concentrated sulfuric acid ($H_2SO_4$) and a concentrated nitric acid ($HNO_3$) at a mixing ratio of 1:2 were mixed with 85-90% by weight of radioactive waste petroleum (R) used in a nuclear power station.

As a result of the mixture, a modified waste petroleum (R'), precipitates (R") and ion products (containing ions, such as $3H^{+3}$, $SO4^{-2}$, and $NO_3^-$) are produced. An exothermic reaction occurs in this mixing step.

After mixing the precipitates (R") with ion products homogeneously, 10-15% by weight of a saturated aqueous sodium hydroxide solution ($Na^+OH^-+H^+_2O^{-2}$) was added to 85-90% by weight of a total amount of the mixture to cause a polymerization to produce small solid particles. The solid particles are then stirred uniformly to obtain a mixture, and the mixture was colloidized like gruel.

Figure 1:
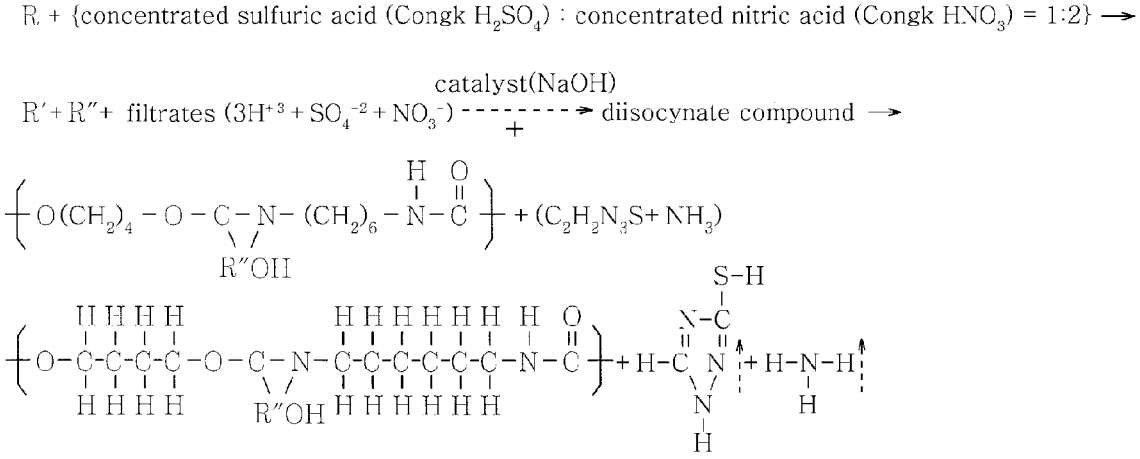
FIG. 1 is a schematic chemical formula illustrating the method for treating waste petroleum of the present invention.

Before cooling the reactor and thus, while an exothermic reaction continues, 10-15% by weight of diisocyanate compound was added to 85-90% by weight of the stirred mixture to cause a series of a polymerization. As a result of the polymerization, a new compound in the form of powders was produced and brown gas was generated. (See FIG. 1)

Figure 2:
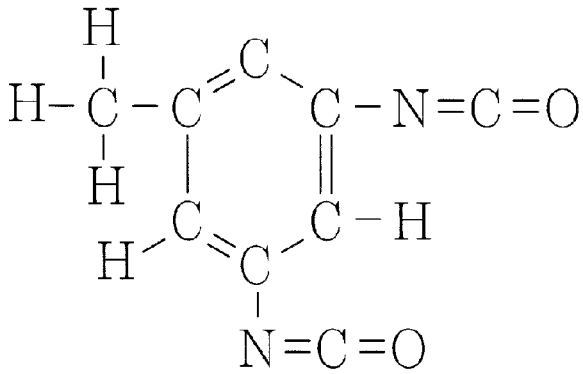
FIG. 2 through FIG. 4 are chemical formulas of various diisocyanates and triisocyanates used in the present invention.
Figure 3:
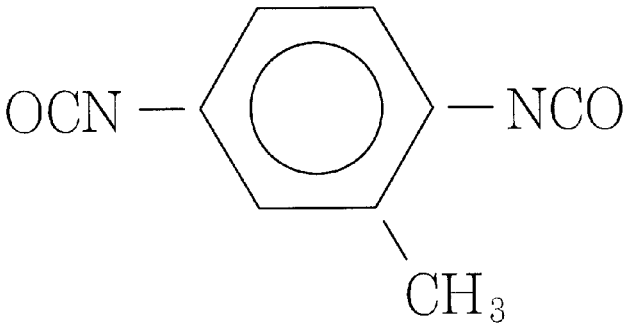
Figure 4:
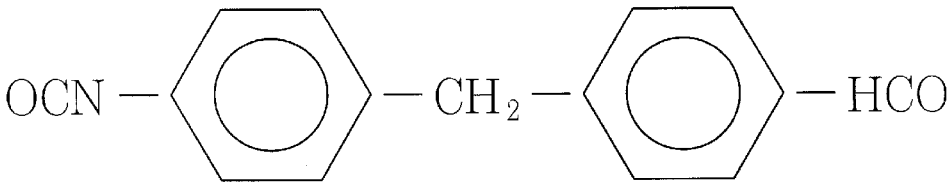
Figure 5:
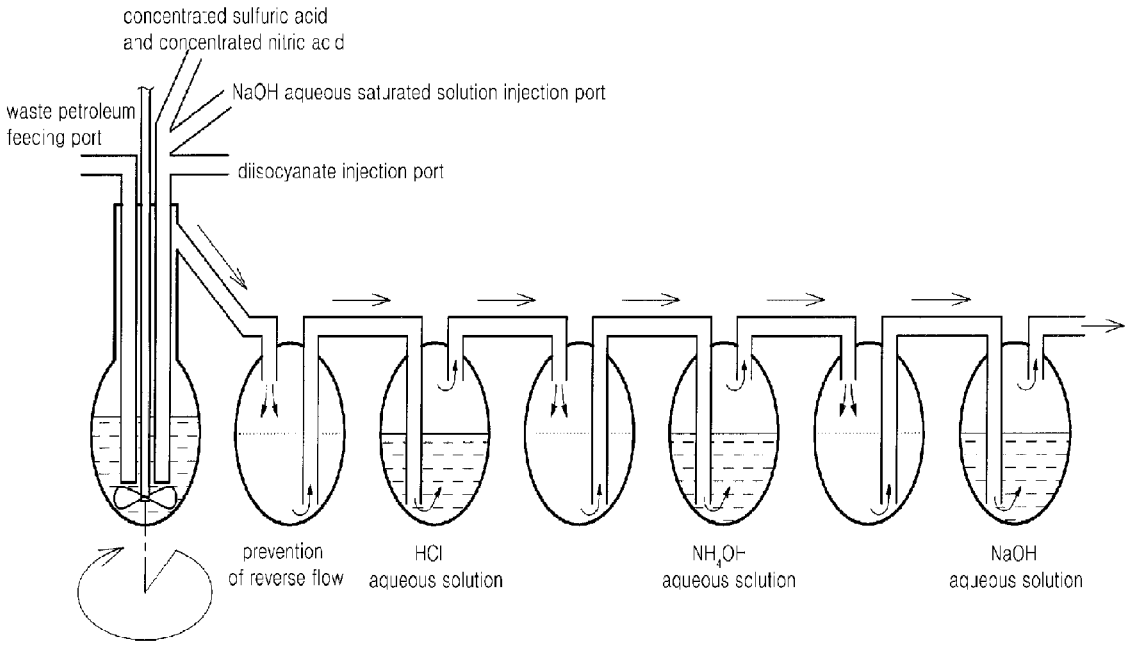
FIG. 5 is a flow chart illustrating approximately the method for treating waste petroleum of the present invention.

Many diisocyanates having various kinds of formula as depicted in FIG. 2 and FIG. 3 can be used selectively as the diisocyanate, and if appropriate a triisocyanate as depicted in FIG. 4 can be used.

And the brown gas was discharged to an atmosphere as an odorless gas after purification by way of three times of complex reactions.

Meanwhile, a compound produced as precipitates in a bottom of a reactor was a very stable brown composition in the form of powder that having odorless properties, refractory properties, water resistance, acid resistance and base resistance.

Since the brown composition is fine powders like a soil, and has a greater specific gravity than that of a water, the composition can be compression-molded (i.e., can be solidified or can be blocked) in a certain shape by adding the composition as filling material into an epoxy resin or an urea resin, a thermoplastic resin such as melamin. Accordingly, permanent reclamation of the wastes can be carried out readily. Further, the composition can be used as recycle materials such as basic materials for construction, and filling materials for asphalts that are produced by using the composition.

The concentrated sulfuric acid that was reacted with waste petroleum in the process can be replaced by hydrogen sulfide ($H_2S$) to carry out same reaction.

A new compound produced by treating waste petroleum does not carry out any ionization reaction with hydrochloric acid, nitric acid and the like because of its acid resistance and does not react in a strong base such as sodium hydroxide, potassium hydroxide and the like. Further, since the compound has refractory properties on firing, it did not cause a secondary environmental pollution.

It will be understood that the present invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying claims.

INDUSTRIAL APPLICABILITY

As described above, the method of the present invention can treat radioactive waste petroleum used in a nuclear power station as well as various waste petroleum, thereby stabilizing waste petroleum chemically and physically, wherein the method comprises mixing waste petroleum with a concentrated sulfuric acid and a concentrated nitric acid; adding sodium hydroxide, thereby carrying out a polymerization reaction to produce solid particles; colloidizing a mixture obtained by uniformly stirring the solid particles; adding a diisocyanate compound in reactor, thereby carrying out a subsequent polymerization reaction to obtain a new compound in the form of powder; discharging a generated gas into the atmosphere; and filling the compound into a resin as a filling material and compression molding and reclaiming the filled compound.

Further, a new compound produced by treating waste petroleum according to the present invention, can be compression-molded as block with various resins and can be reclaimed readily. Also, there are no problems caused by an oil leaching.

Accordingly, the present invention is excellent invention that can prevent secondary industrial pollutions caused by waste petroleum, specifically waste petroleum used in a nuclear power station.

What is claimed is:

1. A method for treating waste petroleum, comprising the following steps of:

(a) mixing a 10-15% by weight mixed solution of sulfuric acid and nitric acid at a ratio of 1:2, with a 85-90% by weight waste petroleum;

(b) producing precipitates, ion products containing at least one ion selected from $3H^{+3}$, $SO4^{-2}$, and $NO_3^-$, and modified waste petroleum by the mixing step (a);

(c) adding a 10-15% by weight saturated aqueous sodium hydroxide solution to a 85-90% by weight homogeneous mixture of the precipitates, the ion products, and the modified waste petroleum, thereby carrying out a polymerization reaction to produce solid particles;

(d) colloidizing a mixture obtained by uniformly stirring the solid particles (e) adding a 10-15% by weight diisocyanate compound to a 85-90% by weight of the colloidized mixture before reactor cooling of the colloidized mixture, thereby carrying out a subsequent polymerization reaction serially to obtain a powder with a gas;

(f) purifying the gas generated in the polymerization reaction in step (e) and discharging the purified gas into the atmosphere; and (g) filling the powder obtained in step (e) into a resin as a filling material and compression molding and reclaiming the filled powder.

* * * * *